United States Patent [19]

Haney

[11] Patent Number: 4,754,874

[45] Date of Patent: Jul. 5, 1988

[54] BAR SOAP AND ITS PACKAGE

[76] Inventors: Robert J. Haney, 11333 Bluff Road, Traverse City, Mich. 49684

[21] Appl. No.: 7,911

[22] Filed: Jan. 28, 1987

[51] Int. Cl.[4] ..... A47K 5/00; C11D 15/00; C11D 13/00

[52] U.S. Cl. ..... 206/77.1; 206/223; 206/524.1; 206/45.34; 206/459; 220/352; 220/358; 220/306; 220/377; 132/79 R; 252/90; 252/93

[58] Field of Search ..... 252/90–93; 206/77.1, 45.34, 216, 223, 524.1, 581; 220/306, 358, 352, 377

[56] References Cited

U.S. PATENT DOCUMENTS

| | | | |
|---|---|---|---|
| 2,932,386 | 4/1960 | Ushkow | 220/306 X |
| 3,149,188 | 9/1964 | Schmitt . | |
| 3,294,274 | 12/1966 | Spitzberg | 220/358 |
| 3,351,227 | 11/1967 | Collie | 220/306 |
| 3,401,825 | 9/1968 | Weiss | 220/306 |
| 3,688,895 | 9/1972 | Wilson | 206/77.1 X |
| 3,921,801 | 11/1975 | Sway | 206/77.1 X |
| 4,144,967 | 3/1979 | Craven et al. | 206/581 X |
| 4,335,007 | 6/1982 | Owens | 252/92 |
| 4,406,364 | 9/1983 | Bronander, Jr. | 206/77.1 |
| 4,569,780 | 2/1986 | Fernholz et al. | 252/90 |

FOREIGN PATENT DOCUMENTS

| | | | |
|---|---|---|---|
| 1424579 | 12/1965 | France | 206/77.1 |

OTHER PUBLICATIONS

Packaging "Thermoformed Soap Package", Sep. 1981, vol. 31, No. 10, p. 48.

*Primary Examiner*—William Price
*Attorney, Agent, or Firm*—Charles M. Kaplan

[57] ABSTRACT

A transparent, mild, low pH bar of soap has a specific formulation that enables it to be molded easily and distributed in a transparent plastic container that is usable as a travel case and has a lid usable as a reversible soap dish.

20 Claims, 1 Drawing Sheet

BAR SOAP AND ITS PACKAGE

BACKGROUND OF THE INVENTION

Transparent, mild body soap bars have been difficult to manufacture and package for retail distribution; this has contributed to their relatively high cost. Also, it has been inconvenient for travelers to use such soaps because they soften excessively if left in contact with moisture, and this has reduced their appeal.

OBJECTIVES OF THE INVENTION

Accordingly, it is an object of my invention to provide an improved bar soap formulation and an improved package for such soap.

Another object is to provide an improved, re-usable, flexible package in which a solid consumer product can be molded, distributed, retailed, and stored while being used.

Another object is to provide a bar soap package that also serves as the mold for the bar, travel case, and a soap dish.

Another object is to provide a travel case for soap with a removable lid that is usable as a soap dish.

Another object is to provide a soap travel case lid that is reversible with either of its surfaces being usable as a soap dish.

Another object is to provide a transparent, mild flat-sided bar soap that is relatively easy to manufacture and package for retail distribution in a mold that serves as a travel case and soap dish, and which does not possess defects found in prior art bar soaps or their packaging.

Other objects and advantages of my invention will be revealed in the specifications and claims, and the scope of the invention will be set forth in the claims.

DESCRIPTION OF THE INVENTION

Figures 1, 2, 3, 4, 5, 6, 7, 8, 9:
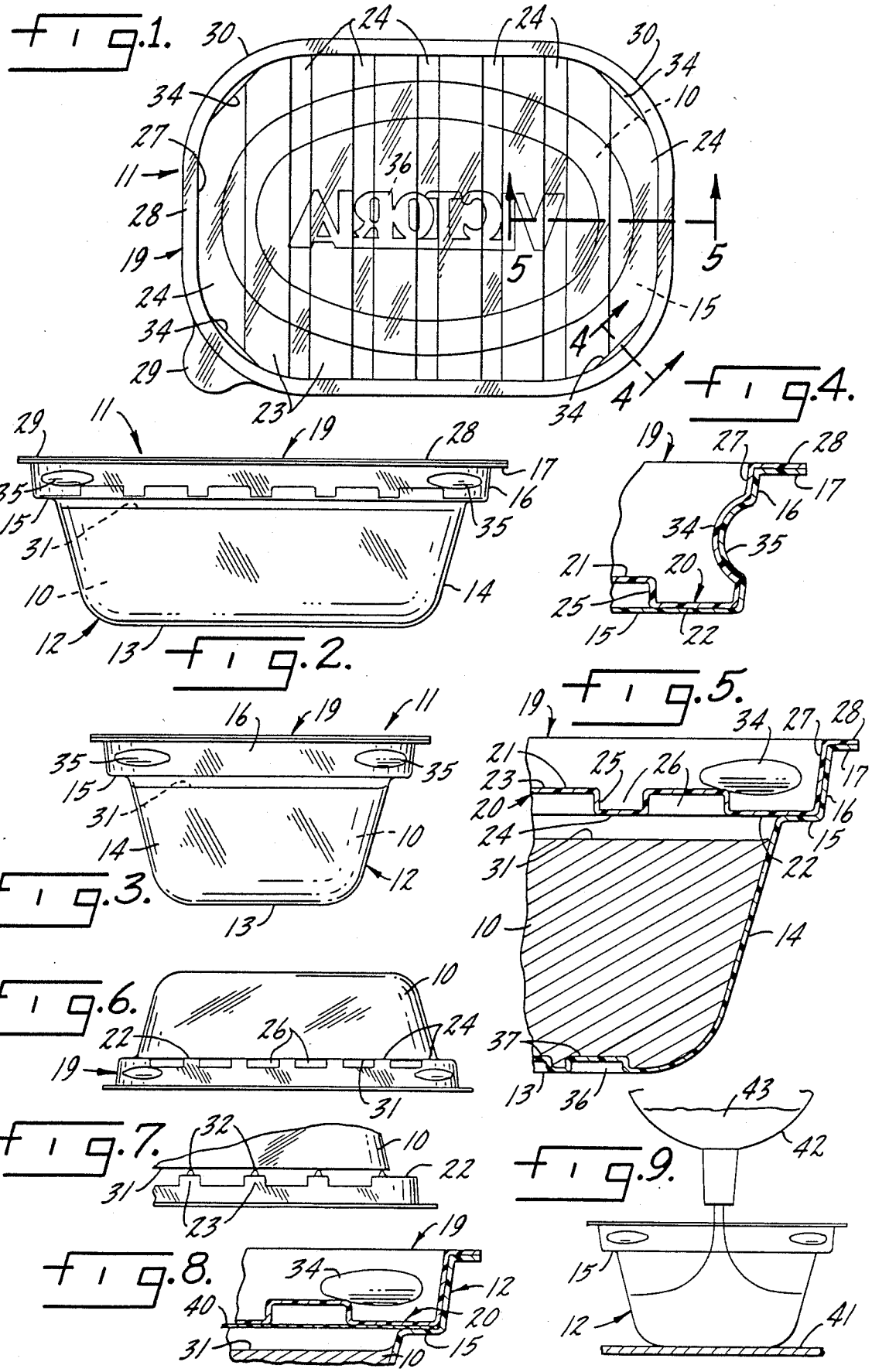
FIG. 1 is a top plan view of an embodiment of my invention.
FIG. 2 is a side view of my invention.
FIG. 3 is an end view of my invention.
FIG. 4 is an enlarged fragmentary cross sectional view taken along the line 4—4 in FIG. 1.
FIG. 5 is an enlarged fragmentary cross sectional view taken along the line 5—5 in FIG. 1.
FIG. 6 is a side view on a reduced scale of the lid being used as a soap dish.
FIG. 7 is a fragmentary side view of another embodiment of my invention.
FIG. 8 is a fragmentary cross sectional view of another embodiment of my invention.
FIG. 9 is a schematic representation showing how the bar soap of my invention is manufactured.

The drawing shows a transparent, mild, low pH soap bar 10 in a container 11 that was used as the mold in which bar 10 was manufactured and which is also usable as its travel case and soap dish. Container 11 includes a relatively deep, open-topped, integral lower receptacle 12 made from a transparent flexible plastic, that is from about 0.010 to 0.030 and preferably about 0.020 inches thick. Receptacle 12 has a generally oval bottom portion 13 that merges into an upwardly extending slanted side wall 14 that causes the receptacle to have an expanding area in the direction away from bottom 13; this shape facilitates pouring molten soap into receptacle 12 when bar 10 is being manufactured and removal of bar 10 when needed for use. An upper closure portion of receptacle 12 includes a generally horizontal rim 15 surrounding and extending away from wall 14. Rim 15 has a generally elliptical innermost edge. A generally vertical upstanding wall 16 extends upwardly from the outermost edge of rim 15, and a generally horizontal peripheral flange 17 extends beyond and surrounds wall 16. The corners of wall 16 should be rounded.

An integral, relatively shallow upper lid 19 made from the same plastic as receptacle 12 is used to close container 11. Lid 19 has a bottom wall 20 that includes vertically spaced upper surface 21 and lower surface 22 that lie in a pair of substantially parallel horizontal planes. Upper surface 21 is defined by a plurality of horizontally spaced transverse horizontal segments 23 that lie in the same plane. Lower surface 22 is defined by a plurality of horizontally spaced transverse horizontal segments 24 that lie in the same plane. The horizontal spaces in surface 21 are opposed by the segments 24 in surface 22, and the horizontal spaces in surface 22 are opposed by the segments 23 in surface 21. Transverse vertical segments 25 connect adjacent horizontal segments 23 and 24. Each pair of adjacent vertical segments 25 connected to the same horizontal segment 23 or 24 define a drainage channel 26 with such horizontal segment for removing water from bar 10. An upstanding vertical wall 27 extends above and around bottom wall 20, and a generally horizontal peripheral flange 28 extends beyond and around wall 27. Lid 19 closes receptacle 12 because lower surface 22 of bottom wall 20 lies on top of rim 15, upstanding wall 27 is located within and in contact with wall 16, and flange 28 lies on top of flange 17. A pull tab 29 on flange 28 makes removal of lid 19 easier, and the corners of the lid should be rounded at 30. The segments 24 at each end of surface 22 are wider than the remaining segments 24 so that they add stiffness to bottom 20 at its ends.

After lid 19 is lifted from container 11, bar 10 can be removed by pressing bottom 13 until it flexes inwardly against the bar. After bar 10 has been used to wash, the water on it should be drained away. Lid 19 is usable as a soap dish and preferably will be turned upside down as shown in FIG. 6 with bar 10 resting on the segments 24 that define surface 22. Channels 26 permit water to drain away from bar 10 and allow air to reach and dry the flat side 31 of the bar very quickly. Since few surfaces are perfectly horizontal, bar 10 may slide off surface 22 when lid 19 is placed on a slanted surface. In such case, lid 19 can be reversed and bar 10 placed on surface 23, and wall 27 will hold the bar in the dish. This orientation of lid 19 does not permit bar 10 to drain or dry as effectively as is shown in FIG. 6, but it is satisfactory when used on a temporary basis such as during a shower.

FIG. 7 shows another embodiment of my invention that is identical to FIGS. 1–6 except that each segment 24 has a plurality of spaced sharp conical projections 32 extending from it. Projections 32 point away from surface 22 and are located within the confines of the area surrounded by the innermost edge of the rim 15. Projections 32 bite into bar 10 and thus hold the bar on surface 22 even if surface 22 tilts significantly as a result of lid 19 being placed on a surface that is not horizontal.

After bar 10 has been used for washing and is returned to lower receptacle 12, a soap film ordinarily is left on the mating surfaces of lid 19 and receptacle 12.

This film causes lid 19 to pop off receptacle 12 unless interacting means are provided on the lid and receptacle to hold on the lid. At each rounded corner 30, lid 19 has an elongated generally oval depression 34 in wall 27. A correspondingly shaped protrusion 35 in wall 16 of receptacle 12 mates with each depression 34. Protrusions 35 easily snap into and out of depressions 34 facilitating removal and closing of lid 19, and this arrangement keeps lid 19 on when the surfaces are wet and soapy. It is also possible to reverse the location of the protrusions 35 and depressions 34 with the depressions being on receptacle 12 and the protrusions being on lid 19.

Indicia such as a trademark 36 may be embossed in the outer surface of bottom 13 of receptacle 12. This will cause spaced parts 37 of the bottom to extend upwardly into receptacle 12 and thereby to cause such indicia to be molded into the under surface of bar 10. The opposite surface 31 of bar 10 is essentially flat because as the molten soap hardened in receptacle 12, its upper surface smooths out at one level. Flat surface 31 enables bar 10 to stay on and be drained by the flat surface 22 of lid 19.

In environments with high humidity, the shelf life of bar 10 can be increased by hermetically sealing container 11. As shown in FIG. 8, this can be accomplished by placing a removable layer of sealing material 40, such as transparent pressure sensitive tape, between bottom 20 of lid 19 and rim 15 of receptacle 12. Such tape should be pressed against rim 15 around the entire surface of the rim, and the tape will be kept from peeling off prematurely by the pressure of lid 19 against its upper surface.

Bar 10 is molded in receptacle 12 by placing the receptacles on a conveyor 41 and moving the receptacles under a gravity flow hopper 42 containing molten soap 43. A predetermined weight of molten soap is fed into each receptacle 12 filling the receptacle to just below its rim 15. The filled receptacle is moved to another location where it cools until the soap is partially hardened, and then lid 19, or a sealing layer 40 and lid 19, is applied.

Numerous transparent soap formulations were tried before the formulation of the present invention was discovered. Only the following emulsion had the desirable characteristics of mildness and low pH in a bar that is transparent, bubble-free, moldable in and removable from container 11:

| Ingredient (USP grade) | % by Weight |
|---|---|
| Sodium Sterate | 24.5 |
| Glycerine | 18 |
| Cocomide DEA | 17 |
| Sodium Cocoyl Sarcosine | 11 |
| Distilled Water | 11 |
| Sorbeth 40 | 9 |
| Propylene Glycol | 8 |
| Tetra Sodium EDTA | 1 |
| HypoAllergenic Fragrance | 0.5 |
| FD & C Color | Trace |

The sodium stearate, glycerine, sorbeth 40 (sorbitol) and propylene glycol are emollients. The cocomide DEA and sodium cocoyl sarcosine are surfactants, and the tetra sodium EDTA is a chelating agent. All ingredients are grade USP (pharmaceutical) and the fragrance is hypo-allergenic. The color may be FD&C yellow #6. A bar of this soap produces high lather, is free rinsing and non-drying. It is compatable with containers 11 made from a wide variety of plastics such as transparent virgin and reprocessed vinyl, high impact polystyrene, and polyethylene terephthalate glycol (modified). A soap bar made from the above formulation tightly adheres to lower receptacle 12 during retail distribution. The pH of bar 10 should be from about 8.0 to 8.6 and preferably is 8.3.

It has thus been shown that by the practice of my invention a three piece package includes a solid product such as a bar 10 of bubble-free, transparent, mild, moldable soap, in a container 11 that first serves as the mold for the bar, then the package for retail distribution of the bar, and finally is re-usable as a travel case and soap dish for the bar. The flexible lid 19 is usable as a reversible soap dish that in one position provides fast drainage and drying of bar 10 on horizontal surfaces, yet in another position can retain the bar temporarily when a horizontal surface is not available. If bar 10 sticks to lid 19 after it dries, the bar can be popped off without tearing, simply by flexing lid 19. The shape of container 11 permits easy molding and removal of bar 10, and flat rim 15 provides a surface that can be hermetically sealed easily with tape 40. The mating oval depressions 34 and protrusions 35 hold lid 19 on receptacle 12 even though those parts are wet and soapy. Bar 10 tightly adheres to lower receptacle 12 before container 11 is opened and thus will not move around in the container and be damaged while the product is being distributed; this also makes the package an attractive way to display bar 10 for sale when container 11 is transparent.

While my invention has been described with reference to particular embodiments, I do not intend to illustrate or describe herein all of the equivalent forms or ramifications thereof. Also, the words used are words of description rather than limitation, and various changes may be made without departing from the spirit or scope of my invention disclosed herein. For example, words such as upper and lower or vertical and horizontal will have their meaning changed when the container 11 is oriented differently than as shown in the drawing. It is intended that the appended claims cover all such changes as fall within the true spirit and scope of the my invention.

What I claim as new and desire to secure by Letters Patent of the United States is:

1. A mold, travel case and bar of soap combined into a three piece package, comprising:

A. a relatively deep, open-topped, lower receptacle having a bottom portion in which said bar of soap is molded and held, and an upper closure portion on said receptacle that is larger in its horizontal dimensions than said bottom portion;

B. said bar of soap being molded in and substantially filling said bottom portion below said upper closure portion and having a flat top; and C. a relatively shallow upper lid closing said lower receptacle, said lid being larger in its horizontal dimensions than said bottom portion and closely nesting into said upper closure portion in frictional engagement therewith so as to provide, with said lower receptacle, a container and travel case for said bar of soap, at least one surface of said lid having a flat horizontal surface capable of acting as a soap dish draining water from said bar, said lid having a bottom wall comprising upper and lower vertically spaced transverse surfaces lying in a pair of substantially parallel horizontal planes, each of said vertically spaced surfaces comprising a plurality of horizontally spaced transverse horizontal segments connected by transverse vertical segments to adjacent segments defining the other surface, the horizontal spaces in each surface being opposed by the segments defining the other surface, and each pair of adjacent vertical segments connected to the same horizontal segment being capable of providing, with such horizontal segment, a drainage channel for removing water from said bar of soap.

2. The invention defined in claim 1 further comprising an upstanding wall extending above and surrounding said bottom wall of said lid, said lid being reversible as a soap dish, and said upstanding wall preventing said soap from sliding off said dish when said wall is oriented above said bottom wall.

3. The invention defined in claim 1, further comprising means on said upper closure portion and on said lid interacting to hold said lid in said upper closure portion.

4. The invention defined in claim 1, further comprising a plurality of sharp projections extending from said segments defining said lower surface of said lid, said projections pointing away from said upper surface of said lid, whereby when said lid is removed and reversed for use as a soap dish with said lower surface being its uppermost surface, said projections prevent said soap from sliding off said lid.

5. The invention defined in claim 1, further comprising a removable transparent plastic sheet adhering to said upper closure portion below said lid, and said sheet hermetically sealing said lower receptacle.

6. The invention defined in claim 1, wherein said bar of soap comprises the following ingredients:

| Ingredient (USP grade) | % by Weight |
|---|---|
| Sodium Sterate | 24.5 |
| Glycerine | 18 |
| Cocomide DEA | 17 |
| Sodium Cocoyl Sarcosine | 11 |
| Distilled Water | 11 |
| Sorbeth 40 | 9 |
| Propylene Glycol | 8 |
| Tetra Sodium EDTA | 1 |
| HypoAllergenic Fragrance | 0.5 |
| Color | Trace |

7. A mold, travel case, soap dish and bar of soap combined into a three piece package, comprising:

A. a relatively deep open-topped, integral, flexible lower receptacle having a bottom portion that merges into an upwardly extending side wall, a generally horizontal rim surrounding said side wall, a generally vertical upstanding wall extending above said rim, and a generally horizontal peripheral flange extending beyond said upstanding wall;

B. a flat-topped, transparent, removable bar of soap molded into said lower receptacle and substantially filling said bottom portion below said rim; and C. an integral, relatively shallow, flexible upper lid closing said lower receptacle, said lid having a bottom wall comprising upper and lower vertically spaced surfaces lying in a pair of substantially parallel horizontal planes, each of said vertically spaces surfaces comprising a plurality of horizontally spaced transverse horizontal segments connected by transverse vertical segments to adjacent segments defining the other surface, the horizontal spaces in each surface being opposed by the segments defining the other surface, each pair of adjacent vertical surfaces connected to the same horizontal segment being capable of providing, with such horizontal segment, drainage channels for removing water from said bar of soap, an upstanding wall extending above and around said bottom wall, and a generally horizontal peripheral flange extending beyond said upstanding wall, said lower surface of said bottom wall lying on top of said rim of said receptacle, said upstanding wall of said lid being located within and being in contact with said upstanding wall of said receptacle, said flange of said lid lying on top of said flange of said receptacle, and means on said lid and said receptacle interacting so as to hold said lid in contact with said receptacle, whereby, without said lid, said lower receptacle provides a mold into which said soap in molten form is poured and allowed to harden, said lid thereafter closing said receptacle and providing with said receptacle a travel case for said soap, and said lid also providing a reversible dish either surface of which is usable for elevating said soap for drainage of water through said drainage channels after removal of said soap and said lid from said receptacle.

8. The invention as defined in claim 7, wherein the interacting means holding said lid and receptacle together comprises a plurality of oval protrusions extending from the upstanding wall of either said receptacle or said lid and entering correspondingly shaped oval depressions on the other upstanding wall.

9. The invention as defined in claim 8, wherein said upstanding walls have rounded corners and said protrusions and depressions are located on said rounded corners.

10. The invention as defined in claim 7, wherein a plurality of sharp projections extend from each of said segments defining said lower surface of said lid, and said projections point in a direction away from said upper surface of said lid.

11. The invention as defined in claim 7, wherein the horizontal segments that define each end of said lower surface of said lid are wider than the remaining segments of said lower surface.

12. The invention as defined in claim 7, further comprising a lifting tab extending from said flange of said lid.

13. The invention as defined in claim 7, wherein spaced parts of said bottom portion extend upwardly so as to define indicia that are molded into the surface of said bar of soap.

14. The invention as defined in claim 7, further comprising a removable transparent plastic sheet adhering to said rim of said lower receptacle below said lid, and said sheet hermetically sealing said lower receptacle.

15. The invention as defined in claim 7, wherein said bar of soap comprises the following ingredients:

| Ingredient (USP grade) | % by Weight |
|---|---|
| Sodium Sterate | 24.5 |
| Glycerine | 18 |
| Cocomide DEA | 17 |
| Sodium Cocoyl Sarcosine | 11 |
| Distilled Water | 11 |
| Sorbeth 40 | 9 |
| Propylene Glycol | 8 |
| Tetra Sodium EDTA | 1 |

-continued

| Ingredient (USP grade) | % by Weight |
|---|---|
| HypoAllergenic Fragrance | 0.5 |
| Color | Trace |

16. A mold, travel case, soap dish and bar of soap combined into a three piece package, comprising:

A. a relatively deep open-topped, integral, flexible lower receptacle having a generally oval bottom portion that merges into an upwardly extending slanted side wall that causes said receptacle to have an expanding cross-sectional area in the direction away from said bottom, an upper closure portion of said receptacle having a generally horizontal rim surrounding and extending away from said side wall, a generally vertical upstanding wall extending above said rim, said upstanding wall having rounded corners, and a generally horizontal peripheral flange extending beyond and surrounding said upstanding wall;

B. a flat-topped, removable bar of soap molded into said lower receptacle and substantially filling said bottom portion below said rim; and C. an integral, relatively shallow, flexible upper lid closing said lower receptacle, said lid comprising a bottom wall having a flat surface with means that define elongated, spaced, transverse drainage channels for removing water from said bar and promoting air flow under said bar, said drainage channels extending continuously from one edge of said bottom wall to its opposite edge, an upstanding wall extending above and around said bottom wall, said upstanding wall having rounded corners, and a generally horizontal peripheral flange extending beyond and around said upstanding wall, said lower surface of said bottom wall lying on top of said rim of said receptacle in contact therewith, said upstanding wall of said lid being located within and being in contact with said upstanding wall of said receptacle, said flange of said lid lying on top of and being in contact with said flange of said receptacle, and means on said lid and said receptacle interacting so as to hold said lid in contact with said receptacle, whereby, without said lid, said lower receptacle provides an open-topped mold into which said soap in molten form is poured and allowed to harden to form said bar, said lid thereafter closing said receptacle and providing with said receptacle a travel case for said bar, and said lid also providing a soap dish for holding said bar and for draining water from said bar after removal of said bar from said receptacle.

17. The invention defined in claim 16 wherein said drainage channels comprise said bottom wall of said lid having upper and lower vertically spaced segments that enable said lid to be used as a reversible soap dish that in one position provides fast drainage and drying of said bar on horizontal surfaces, and in its reversed position retains said bar when said lid is not on a horizontal surface.

18. The invention defined in claim 17 wherein some of said segments are outside of said upstanding wall of said lid and the other segments that are spaced vertically from the first mentioned segments are within said upstanding wall of said lid, and said upstanding wall of said lid retains said bar on said other segments when said lid is not on a horizontal surface.

19. The invention defined in claim 17 wherein said upper segments are within said upstanding wall of said lid for supporting said bar when said lid is not on a horizontal surface, and said upstanding wall retains said bar on said upper segments.

20. The invention defined in claim 16 wherein said bar of soap comprises the following ingredients:

| Ingredient (USP grade) | % by Weight |
|---|---|
| Sodium Sterate | 24.5 |
| Glycerine | 18 |
| Cocomide DEA | 17 |
| Sodium Cocoyl Sarcosine | 11 |
| Distilled Water | 11 |
| Sorbeth 40 | 9 |
| Propylene Glycol | 8 |
| Tetra Sodium EDTA | 1 |
| HypoAllergenic Fragrance | 0.5 |
| Color | Trace |

* * * * *